US007980191B2

(12) United States Patent
Murphy

(10) Patent No.: US 7,980,191 B2
(45) Date of Patent: Jul. 19, 2011

(54) EXTRUDED STRUT, FUSELAGE AND FRONT WING ASSEMBLY FOR TOWABLE HYDROFOIL

(76) Inventor: Michael J. Murphy, Canyon Lake, CA (US)

( * ) Notice: Subject to any disclaimer, the term of this patent is extended or adjusted under 35 U.S.C. 154(b) by 1526 days.

(21) Appl. No.: 11/186,356

(22) Filed: Jul. 20, 2005

(65) Prior Publication Data

US 2005/0266746 A1 Dec. 1, 2005

Related U.S. Application Data

(63) Continuation-in-part of application No. 10/897,363, filed on Jul. 21, 2004, now abandoned.

(60) Provisional application No. 60/524,657, filed on Nov. 25, 2003.

(51) Int. Cl.
*B64D 27/00* (2006.01)

(52) U.S. Cl. ..... 114/274; 441/65

(58) Field of Classification Search ..... 114/274–282; 441/65

See application file for complete search history.

(56) References Cited

U.S. PATENT DOCUMENTS

| | | | |
|---|---|---|---|
| 2,452,280 | A | 10/1948 | Zahller |
| 2,707,986 | A | 5/1955 | Johnson |
| 2,721,088 | A | 10/1955 | Ritter, Jr. |
| 3,260,232 | A | 7/1966 | Douglas |
| 3,325,179 | A | 6/1967 | Bissett |
| 4,014,283 | A | 3/1977 | Crnogorac |
| 4,027,614 | A | 6/1977 | Jones |
| 4,193,609 | A | 3/1980 | Bissett |
| 4,260,036 | A | 4/1981 | Bissett |
| D261,022 | S | 9/1981 | Hoskins |
| 4,421,193 | A | 12/1983 | Bissett |
| 4,589,932 | A | 5/1986 | Park |
| 4,615,291 | A | 10/1986 | Jones |
| 5,100,354 | A | 3/1992 | Woolley et al. |
| 5,151,136 | A | 9/1992 | Witters et al. |
| 5,211,594 | A | 5/1993 | Barrows |
| 5,249,998 | A | 10/1993 | Woolley et al. |
| 5,309,861 | A | 5/1994 | Mardikian |
| 5,321,967 | A | 6/1994 | Wakabayashi |
| 5,329,870 | A | 7/1994 | Cook |
| 5,367,978 | A | 11/1994 | Mardikian |
| 5,478,525 | A | 12/1995 | Smith et al. |
| 5,503,690 | A | 4/1996 | Wade et al. |
| 5,518,080 | A | 5/1996 | Pertile |
| 5,595,085 | A | 1/1997 | Chen |
| 5,603,281 | A | 2/1997 | Harvey et al. |
| 5,820,708 | A | 10/1998 | Jarrett |
| 5,843,247 | A | 12/1998 | Fukagawa et al. |
| 5,870,921 | A | 2/1999 | Piccinin et al. |
| 5,870,922 | A | 2/1999 | Rodriguez et al. |
| 5,911,191 | A | 6/1999 | Burer |
| 5,911,845 | A | 6/1999 | Fukagawa et al. |
| 6,113,711 | A | 9/2000 | Armanie et al. |
| 6,179,676 | B1 | 1/2001 | Wilborn et al. |
| 6,234,856 | B1 | 5/2001 | Woolley |
| 6,386,932 | B1 | 5/2002 | Murphy |
| 6,430,793 | B1 | 8/2002 | Pedersoli |
| 6,443,786 | B2 | 9/2002 | Woolley |
| 6,551,158 | B2 | 4/2003 | Murphy |
| 6,668,611 | B2 | 12/2003 | Kashiwazaki et al. |
| 2005/0112964 | A1 | 5/2005 | Murphy |

*Primary Examiner* — Ed Swinehart
(74) *Attorney, Agent, or Firm* — Joseph E Mueth

(57) ABSTRACT

A towable water sports device having a hydrofoil assembly including a strut, fuselage and front and rear blades carried by the fuselage wherein said parts are extruded aluminum or aluminum alloy.

8 Claims, 3 Drawing Sheets

* CENTER VIEW OF DIE FOR STRUT

* CENTER VIEW OF DIE FOR FUSELAGE

EXTRUDED STRUT, FUSELAGE AND FRONT WING ASSEMBLY FOR TOWABLE HYDROFOIL

This patent application is a continuation-in-part of U.S. patent application Ser. No. 10/897,363 filed Jul. 21, 2004 now abandoned, which in turn, claims the benefit of Provisional Patent Application Ser. No. 60/524,657, filed Nov. 25, 2003.

BACKGROUND OF INVENTION

Towable hydrofoil water sports devices for supporting a human rider are described in U.S. Pat. No. 5,100,354, granted Mar. 31, 1992, U.S. Pat. No. 5,249,998, granted Oct. 5, 1993, U.S. Pat. No. 6,179,676, Jan. 30, 2001, and U.S. Pat. No. 6,551,158, granted Apr. 22, 2003

These towable water sports devices have a strut, fuselage and front and rear wings or blades which are made by casting a molten aluminum alloy. This process requires pouring molten aluminum into a sand or steel mold. The alloy used in this process is, for example, a 356A aluminum which is then heat-treated to T-6 hardness. The casting is then ground or sanded down to eliminate all entry gates, all venting gates and the receiving canals. This requires a lot of grinding, sanding and machining of the cast part after it has been taken out of the mold. Another disadvantage in manufacturing using the cast process is that the metal as it cures releases or gives off gases, resulting in the production of many small voids. This porosity in the part results in a poor finish. In addition as the casting comes out of the mold, there is shrinkage and the extent of the shrinkage is variable due to the nature of the alloy and weather conditions during the curing process. The primary disadvantage of a part cast from 356A aluminum is that it does not have the ability to flex which can result in a catastrophic failure or breakage of the part. There is a large rejection rate when casting an aluminum part due to the temperature of the mold, the outside temperature, and the amount of the metal as it is poured into the mold. The temperature of the mold has to be compatible with the heat of the material poured into the mold and this changes on a daily basis. There is a lack of overall consistency in the parts. The porosity of the cast part is present on the surface of the part. The surface porosity of the cast part adds drag to the foil assembly, which hinders the performance of the hydrofoil assembly. The porosity of the cast part also is not compatible with and does not accept the anodizing process. The anodizing is, however, desirable in that it offers a protective, maintenance free and corrosion-resistant finish.

In a subsequent development, the strut, fuselage and wings or blades have been cut and ground from a single pressed or rolled aluminum or aluminum alloy billet. This process wastes a lot of metal and also requires a lot of machine time. Moreover, since all of the parts are derived from a single billet, the grain that is naturally present in the pressed or rolled aluminum all runs in the same direction throughout. As a result, the grain runs in the same direction in both the strut and the fuselage. The billet is weaker and more subject to snapping off and breaking when force is applied with the grain than when force is applied across the grain. For example, if the billet has been ground and machined so that the grain runs in the same direction as the long dimension of the strut, this means that the grain runs crosswise, across the short or lateral dimension of the fuselage in which case the strut is quite strong and break resistant when towed through the water since the force is mainly across the grain while at the same time, the fuselage is relatively weak and subject to failure since the elongate fuselage when towed at high speed is subject to powerful lateral forces when the fuselage becomes out of alignment with the direction of the tow (which is often the case). When the fuselage lands from a jump, the forces of the water pressure on the wings and wing bolt holes often result in breakage.

Another advantage to extruding the strut is that it allows for the ready shortening or lengthening of the strut to any desired length, that is, one is not married to one length as determined by mold size as in the case in casting the strut.

SUMMARY OF INVENTION

In a water sports device for supporting a human rider while said rider and device are towed, comprising: an elongate board having a front end and a back end; an elongate strut approximately a 90° angle to and extending downward from said board; a fuselage having a forward end and a rearward end fixed at a point between its forward end and rearward end to said strut at a position spaced below said board; a forward wing or blade secured proximate the forward end of said support, generally parallel to said board, wherein said forward wing or blade has a generally water hyrdrofoil cross-section, and a rear wing or blade secured proximate the rearward end of said support, generally parallel to said board, wherein said rearward wing or blade has a generally water hydrofoil cross-section.

the improvement wherein at least said strut and fuselage are made of extruded aluminum or aluminum alloy.

The invention more particularly can be defined as follows:

In a water sports device for supporting a human rider while said rider and device are towed, comprising: an elongate board having a front end and a back end; a holder for securing at least one foot of said rider on the top of said board; an elongate strut of approximately a 90° angle to and extending downward from said board; a fuselage having a forward end and a rearward end fixed at a point between its forward end and rearward end to said strut at a position spaced below said board; a forward wing or blade secured proximate the forward end of said support, generally parallel to said board, wherein said forward wing or blade has a generally water hydrofoil cross-section, and a rear wing or blade secured proximate the rearward end of said support, generally parallel to said board, wherein said rearward wing or blade has a generally water hydrofoil cross-section.

the improvement wherein at least said strut and fuselage are made of extruded aluminum or aluminum alloy.

In one preferred embodiment, the invention is defined as follows;

In a water sports device for supporting a seated human rider while said rider and device are towed behind a powered watercraft, comprising: an elongate board having a front end and a back end; a seat secured to said board for supporting the buttocks of a seated rider at a position spaced above said board; a holder spaced toward the front end of said board from said seat for securing at least one foot of said rider over the top of said board; an elongate strut of a approximately 90° angle to and extending downward from said board; a fuselage having a forward end and a rearward end fixed at a point between its forward end and rearward end to said strut at a position spaced below said board; a forward wing or blade secured proximate the forward end of said support, generally parallel to said board, wherein said forward wing or blade has a generally water hydrofoil cross-section, and a rear wing or blade secured proximate the rearward end of said support, generally parallel to said board, wherein said rearward wing or blade has a generally water hyrdrofoil cross-section.

the improvement wherein at least said strut and fuselage are made of extruded aluminum alloy.

DESCRIPTION OF PREFERRED EMBODIMENTS

The water sport device of this invention may be of the sit on type as variously described in the above-mentioned patents. The water sport device can also be without a seat for the rider in which case the rider either stands upright on the board, or kneels or lays on the board as it is towed. Foot and/or hand holders may be provided at appropriate locations (which are known to those skilled in the art) on the upper surface of the board to enable the rider to hang on as the board is towed.

Turning to that embodiment which is of the sit-on type:

The means for towing the towable water sports devices of this invention are not part of the invention. The towable water sports devices can be towed by a number of means including a powerboat, various kites of the type used to tow kiteboards or by a helicopter.

The invention is applicable to extruded aluminum or aluminum alloy.

The invention preferably uses an extruded aluminum out of a AA6061 alloy heat-treated to T-6 in advance of the extrusion. The 6061 heat-treated aluminum is one of the alloys to be used, but it is not the only one suitable for use in this manufacturing process. For example, suitable aluminum alloys include the AA 6000 series which are disclosed in Park U.S. Pat. No. 4,589,932, and Wade et al U.S. Pat. No. 5,503, 690, the disclosures of which are expressly incorporated herein by reference. This eliminates the need to take the casting from the foundry to a separate location for the heat-treating process. Extrusion does not involve the pouring of metal. The metal is billet or rolled aluminum is pushed or pulled through a pre-cut die. This gives the material a grain as opposed to a porosity as in a part made by the cast process. This grain allows the running of the grain in the long dimension of the part for added strength. This process eliminates the porosity (that offers no strength) and gives the part more strength with completely different characteristics. The extruded part can bend or flex with a memory that allows it to retain its original shape. The extruded part is less brittle which avoids breakage while under stress in use and danger to the rider. Eliminating the porosity on the exterior surface of the part gives it: 1) more visibly aesthetic appearance; 2) polishes up nicely; 3) less drag due to little or no porosity; and 4) it is compatible with the anodizing protective coating. The surface anodizing of aluminum extrusions is described, for example, in Fukagawa et al U.S. Pat. No. 5,911,845.

The advantages of extruded aluminum are applicable to the strut, fuselage, front and rear blade or wing comprising the foil assembly used in a towable hydrofoil.

THE DRAWINGS

Turning to the drawings.

Figure 1:
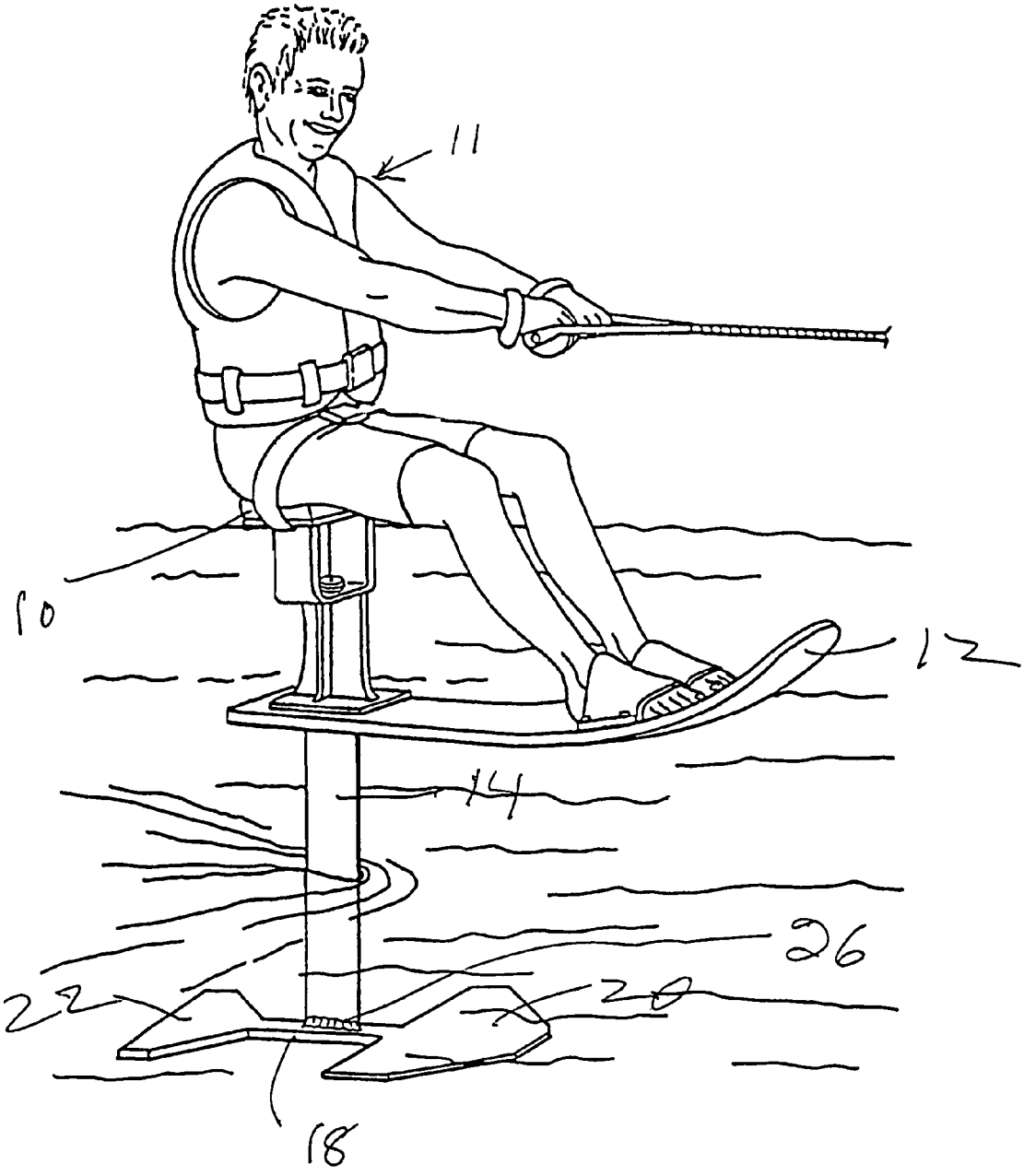
FIG. 1 is a perspective view of a preferred embodiment of the water sport device of this invention with the rider seated and being towed through the water by a power boat (not shown).
Figure 2:
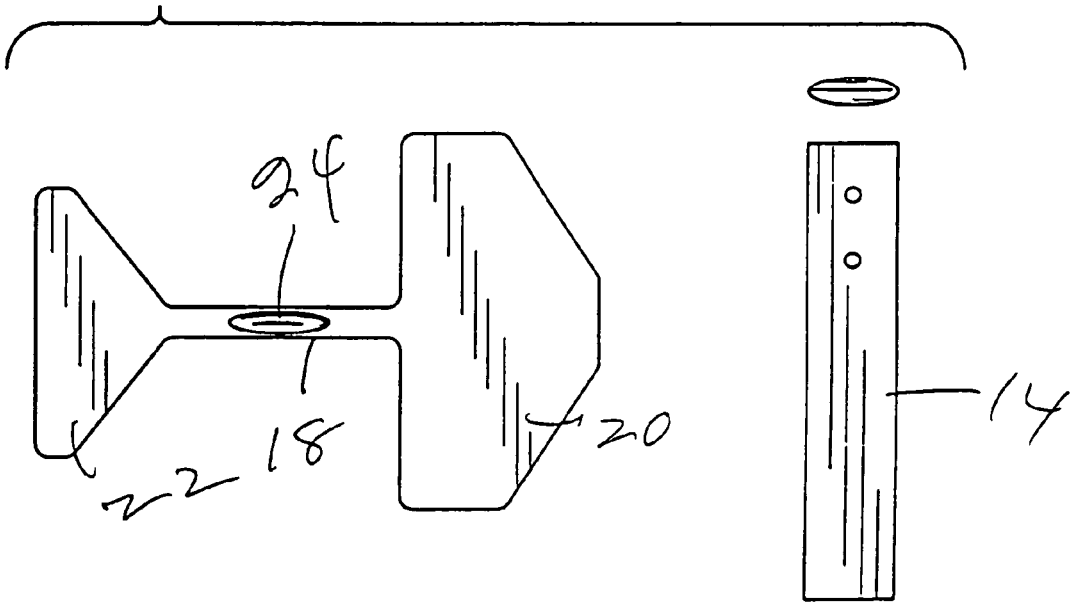
FIG. 2 shows at the left a top plan view of the fuselage and front and rear blades, and at the right, a side view of the strut, the parts being unassembled.
Figure 3:
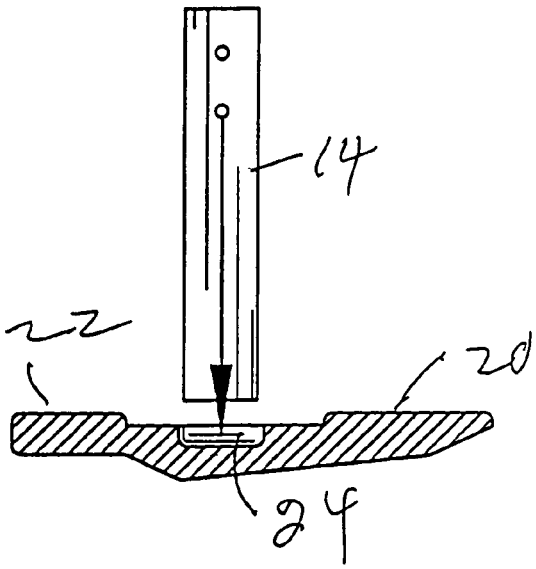
FIG. 3 shows the strut being inserted into the opening provided in the fuselage, the fuselage and blades being shown in longitudinal section.

Turning to the drawings in more detail, the water sports device of this invention has a seat 10 for the rider 11 which is affixed to the curved board 12, the strut 14 projects downwardly from board 12 in a generally perpendicular fashion. The lower end of strut 14 is received in opening 16 of fuselage 18. The fuselage 18 carries the front blade 20 and rear blade 22.

Figure 4:
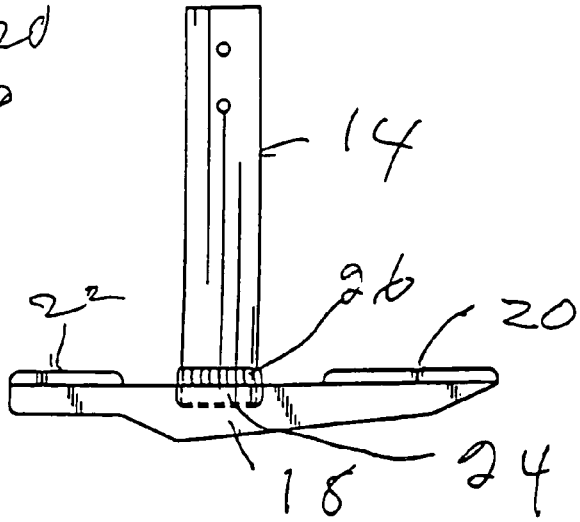
FIG. 4 shows the strut fully in place in the fuselage and welded to the fuselage.
Figure 5:
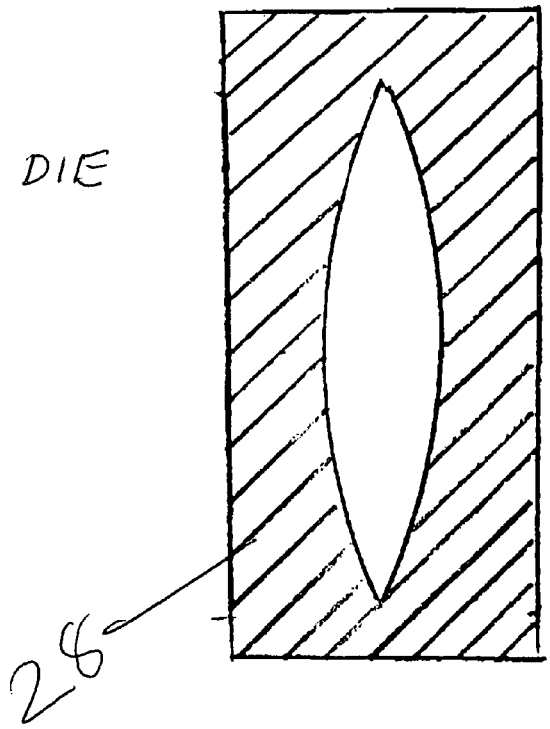
FIG. 5 depicts a die through which aluminum or an aluminum alloy is extruded to make the parts from which the strut is ultimately formed.
Figure 6:
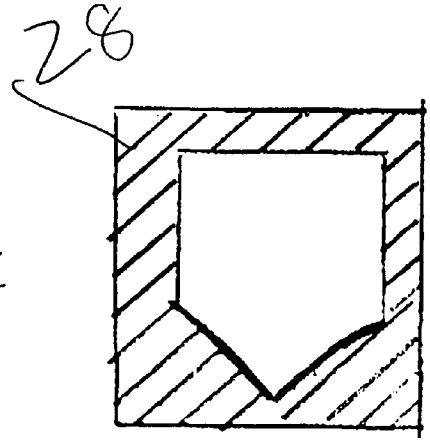
FIG. 6 depicts a die through which aluminum or aluminum alloy is extruded to make the fuselage.

A further feature of this invention concerns the combination of parts. In the past the castings for the foil assembly were three different parts: 1) a t-bar consisting of strut and fuselage as a single component; 2) front wing; and 3) rear wing. The new means of manufacturing includes four parts: 1) the rear wing 22; 2) front wing 20; 3) the strut 14; and 4) the fuselage 18. The strut 14 and the fuselage 18 are heliarced (a means of welding aluminum) together to form the t-bar as shown in FIG. 4. The extruded strut 14 fits into the fuselage slot 24 as shown in the drawings and heliarced 26 as depicted in the drawing. This process is completely new from the previous method of manufacturing in the past. The extrusion process also provides the capability of including the front wing 20 and rear wing 22 within the extruded fuselage 18 as a single unit, thus reducing the number of parts to two. For example, the fuselage 18 and front wing 20 and rear wing 22 can be cut to the desired shape from a single aluminum extrusion using a programmable milling machine which is available in the marketplace. This reduces assembly time since the wings do not have to be joined to the fuselage in separate operations.

It is important to note that the grain of the extrusion in the strut runs lengthwise, that is, with the long dimension of the strut. The grain in the fuselage likewise runs lengthwise, aligned with the long dimension. Resistance to breakage under high impact loading is thus maximized. The extrusions are formed by drawing hot formable aluminum through a die such as dies 28. The extrusion is then quenched and heat treated. The strut can be extruded through a die of appropriate cross section, cut to length and used as such without further working. This process conforms generally to FIG. 1 of Wakabayashi U.S. Pat. No. 5,321,967. The slot 24 is cut into the fuselage. The fuselage, wings and strut in the desired configuration are polished smooth. The resultant surface is quite slick and well adapted to anodizing which provides an esthetically pleasing appearance which is highly resistant to corrosion. The avoidance of corrosion is an important benefit of this invention in that the strut, fuselage and blades or wings remain smooth and do not acquire or build up added drag in the water over time due to oxidation and mineral build-up.

The heliarc process is an oxygen gas mix and can be used for the welding of the extruded parts and it represents one option to be used for welding aluminum parts, but is not the only one available for this method of manufacturing. Other techniques for welding or joining pre-formed aluminum parts are known to those skilled in the art.

The benefits of this invention include a less expensive part, stronger part, more consistent part and a part with less drag, increased performance, and fewer warranty problems. Extrusion has been used in other industries such as screen doors, window frames and others. The present invention is a completely new concept in the manufacturing of hydrofoils for water sport devices and it provides results which are not manifested in prior extruded parts.

The Jones et al patents U.S. Pat. No. 4,615,291 and U.S. Pat. No. 4,027,614 relate to a hydrofoil catamaran boat equipped with sail or power propulsion ('291); and sailboats having retractable hydrofoils ('614). The '291 catamaran states that struts and main hydrofoil are aluminum extrusions. The control hydrofoils are aluminum and their structural supports are from an aluminum tube. In the '614 patent, the clevis' connecting rod or tubes, tube ends, brackets, wheel, rudder, gimbal, and stabilizer are machined out of aluminum bar stock.

It is significant to note that the environment in which Jones '291 uses aluminum extrusions is completely different from the present invention. The present invention relates to towable, sit-on hydrofoils. The water sports devices of the present invention are towed with a seated or standing rider at speed behind a power board. These devices are subject to impact from waves. More importantly, water sport devices of this invention are used to perform jumps and in-the-air twists, all of which severely stress the entire structure. Landings can occur with the device at an angel to the direction of movement of the tow boat, even at a 90° angle. This imposes enormous loads on the strut and fuselage.

The Jones Patents do not disclose any towable devices at all. The Jones Patents relate to water craft which are intended to sail or power through the water. The various hydrofoils and the like in the Jones et al Patents rarely leave the water and are not intended to receive high impact loads such as are encountered when the towable, sit-on hydrofoil slams into the water following jumps as high as 20 feet into the air while moving at speeds up to 35 MPH. The vertical length of towable, sit-on hydrofoils is such that considerable torque can be generated on the strut when a 180 lb rider hits the water.

The Jones Patents are devoid of any direction to use aluminum extrusions in lieu of castings in high impact environments. The towable sit-on hydrofoils of the past have been made of cast aluminum as taught in the Woolley patents discussed above. However, with intensified water sport competition, it has now been discovered that extruded aluminum or aluminum alloy is less prone to failure under high impact loadings.

The invention claimed is:

1. In a water sports device for supporting a human rider while said rider and device are towed, comprising: an elongate board having a front end and a back end; a single elongate strut approximately a 90° angle to and extending downward from said board; a fuselage having a forward end and a rearward end fixed at a point between its forward end and rearward end to said strut at a position spaced below said board; a forward wing or blade secured proximate the forward end of said support, generally parallel to said board, wherein said forward wing or blade has a generally water hydrofoil cross-section, and a rear wing or blade secured proximate the rearward end of said support, generally parallel to said board;

the improvement wherein at least said strut and fuselage are made of extruded aluminum or aluminum alloy.

2. The invention more particularly can be defined as follows:

In a water sports device for supporting a human rider while said rider and device are towed, comprising: a single elongate board having a front end and a back end; a holder for securing at least one foot of said rider on the top of said board; an elongate strut of approximately a 90° angle to and extending downward from said board; a fuselage having a forward end and a rearward end fixed at a point between its forward end and rearward end to said strut at a position spaced below said board; a forward wing or blade secured proximate the forward end of said support, generally parallel to said board, wherein said forward wing or blade has a generally water hydrofoil cross-section, and a rear wing or blade secured proximate the rearward end of said support, generally parallel to said board;

the improvement wherein at least said strut and fuselage are made of extruded aluminum or aluminum alloy, wherein the strut and fuselage are separately extruded and then joined, and further wherein the grain of the extruded strut runs lengthwise in the long dimension of the strut and the grain of the fuselage runs lengthwise in the long dimension of the fuselage.

3. The water sports device of claim 2 wherein the strut, fuselage and front and rear wings are made of extruded aluminum.

4. The water sports device of claim 2 wherein the strut, fuselage and front rear wings are provided with an anodized surface.

5. The water sports device of claim 2 wherein the strut has a lower end which is received in an opening in the fuselage.

6. The water sports device of claim 2 wherein the strut is heliarc welded to the fuselage.

7. The water sports device of claim 2 wherein the extrusion is an aluminum alloy.

8. In a water sports device for supporting a seated human rider while said rider and device are towed behind a powered watercraft, comprising: a single elongate board having a front end and a back end; a seat secured to said board for supporting the buttocks of a seated rider at a position spaced above said board; a holder spaced toward the front end of said board from said seat for securing at least one foot of said rider over the top of said board; an elongate strut of approximately a 90° angle to and extending downward from said board; a fuselage having a forward end and a rearward end fixed at a point between its forward end and rearward end to said strut at a position spaced below said board; a forward wing or blade secured proximate the forward end of said support, generally parallel to said board, wherein said forward wing or blade has a generally water hydrofoil cross-section, and a rear wing or blade secured proximate the rearward end of said support, generally parallel to said board;

the improvement wherein at least said strut and fuselage are made of extruded aluminum alloy, wherein the strut and fuselage are separately extruded and then joined, and further wherein the grain of the extruded strut runs lengthwise in the long dimension of the strut and the grain of the fuselage runs lengthwise in the long dimension of the fuselage.

* * * * *